US007397488B2

(12) United States Patent
Ito et al.

(10) Patent No.: US 7,397,488 B2
(45) Date of Patent: Jul. 8, 2008

(54) IMAGE FORMING APPARATUS

(75) Inventors: Noriyuki Ito, Mishima (JP); Kenichi Ogawa, Numazu (JP); Rikuo Kawakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 433 days.

(21) Appl. No.: 11/211,445

(22) Filed: Aug. 26, 2005

(65) Prior Publication Data

US 2006/0062610 A1 Mar. 23, 2006

(30) Foreign Application Priority Data

Sep. 9, 2004 (JP) ..... 2004-262923
Nov. 8, 2004 (JP) ..... 2004-323639

(51) Int. Cl.
*B41J 2/315* (2006.01)

(52) U.S. Cl. ..... 347/171

(58) Field of Classification Search ..... 347/171, 347/215, 217, 218; 399/45
See application file for complete search history.

(56) References Cited

U.S. PATENT DOCUMENTS

| | | | | |
|---|---|---|---|---|
| 5,552,582 | A | 9/1996 | Abe et al. | 219/619 |
| 5,742,865 | A | 4/1998 | Yajima et al. | 399/43 |
| 5,862,445 | A | 1/1999 | Ogawa et al. | 399/329 |
| 6,734,397 | B2 | 5/2004 | Kato et al. | 219/216 |
| 6,785,506 | B2 | 8/2004 | Kato et al. | 399/333 |
| 6,801,729 | B2 | 10/2004 | Wada et al. | 399/68 |
| 7,010,256 | B2 | 3/2006 | Usui et al. | 399/328 |
| 7,031,624 | B2 | 4/2006 | Kobayashi et al. | 399/44 |
| 2003/0015498 | A1 | 1/2003 | Hirst et al. | 216/89 |
| 2003/0016958 | A1 | 1/2003 | Wada et al. | 399/45 |
| 2003/0077092 | A1 | 4/2003 | Ogawa et al. | 399/328 |

(Continued)

FOREIGN PATENT DOCUMENTS

JP 3-18883 1/1991

(Continued)

OTHER PUBLICATIONS

Official Letter/Search Report issued by The State Intellectual Property Office of P.R. China, on Oct. 12, 2007, in Chinese Application No. 2005100983988, and translation.

(Continued)

*Primary Examiner*—K. Feggins
(74) *Attorney, Agent, or Firm*—Fitzpatrick, Cella, Harper & Scinto

(57) ABSTRACT

The image forming apparatus has a heat member for heating an unfixed image and is configured so that a longitudinal center of the heat member becomes a conveyance center of the recording material, the image forming apparatus including a central portion temperature detection part adjacent to the conveyance center, an end portion temperature detection part for detecting an end portion temperature of the heat member, and a width detection part for detecting a lateral width of the recording material, wherein the width detection part is disposed at a side opposite to a side at which the end portion temperature detection part is disposed with respect to the conveyance center position of the recording material. The image forming apparatus achieves the control for error setting of the recording material based on the width detection part and the end portion temperature detection part.

3 Claims, 13 Drawing Sheets

U.S. PATENT DOCUMENTS

| | | | | |
|---|---|---|---|---|
| 2004/0052542 | A1 | 3/2004 | Kinoshita | 399/69 |
| 2005/0163523 | A1 | 7/2005 | Omata et al. | 399/69 |
| 2006/0062610 | A1 | 3/2006 | Ito et al. | 399/328 |

FOREIGN PATENT DOCUMENTS

| | | |
|---|---|---|
| JP | 4-44075 | 2/1992 |
| JP | 2001-282036 | 10/2001 |
| JP | 2002-296965 | 10/2002 |
| JP | 2003-15498 | 1/2003 |

OTHER PUBLICATIONS

Office Action/Search Report, issued on Nov. 8, 2007, by the European Patent Office, in European Patent Application No. 05018593.3. Official Letter/Search Report.

IMAGE FORMING APPARATUS

BACKGROUND OF THE INVENTION

1. Field of the Invention

The present invention relates to an image forming apparatus which has a heat member for heating a recording material bearing an unfixed image thereon and is configured so that a longitudinal center of the heat member becomes a conveyance center (the center with respect to the direction intersecting with a conveyance direction) of the recording material, that is, relates to an image forming apparatus of an electrophotographic system or the like, for transporting (paper feeding) a recording material by setting a center of the recording material to be transported as reference.

In addition, in this specification, even a plurality kinds of recording materials whose paper widths in a direction intersecting with the conveyance direction differ with each other, in the case of being set correctly, such a configuration that the width center of each recording material is transported at a certain position (generally, a longitudinal center position of the heat member) with respect to the direction intersecting with the conveyance direction is referred to as "a center of the paper feeding reference", and its line is referred to as "a center line of the paper feeding reference".

2. Related Background Art

It has been generally acknowledged that a conventional image forming apparatus of an electrophotographic system is a system which fixes a toner image on a recording material surface by being transported in sandwiched relation while being subject to a heat and a pressure simultaneously by using a heating device which is typified by a heat roller system using a halogen lamp, a film heating system using a ceramic heater, or the like as fixing means of the toner image on the recording material (recording paper).

In such a heating device, when a recording material having a narrow paper width such as a postcard and an envelope is continuously fed, there generates a non-paper feeding part temperature rise that gradually raises temperature at an area where the recording material is not passed. Therefore, as shown in, for example, Japanese Patent Application Laid-Open Nos. 03-18883 and 2001-282036, control that changes a control temperature of heating means and a conveyance time interval of the recording material is generally performed so that a temperature at an end portion, which is a non-paper feeding part of heating means, becomes not more than a predetermined temperature by equipping temperature detection part at an end portion in a longitudinal direction of the heating means in the heating device.

However, in the image forming apparatus using a center of the paper feeding reference which serves as reference for paper feeding of the recording material, there is a possible situation in which a small size recording material is not often set correctly in the center of the paper feeding reference due to miss handling in setting the recording material with respect to a paper feeding part. By this, there is a possibility that the small size recording material is fed and transported to inside the image forming apparatus like one side paper feeding reference conveyance in lateral deviation from a a center of the paper feeding reference line. Therefore, end portion temperature detection part of heating means is covered within the paper feeding area, so that there is a possible situation that the non-paper feeding part temperature rise cannot be detected at all. Consequently, heating means part, which corresponds to a non-paper feeding area width appeared on the end portion side opposite to the side that the end portion temperature detection part is provided, is uncontrollably increased in temperature at the non-paper feeding part; thus, an excessively heated state may occur as the small size recording material is continuously fed and transported.

Further, since only one end portion temperature detection part is provided, more specifically, in an apparatus capable of feeding a recording material of not less than A3 size, it is difficult to accurately detect the highest temperature portion when the recording materials having various kinds of sizes including non-standard sizes are fed, and therefore, it cannot help degrading specification in consideration of safety.

In addition, inventions disclosed in Japanese Patent Laid-open Nos. 2002-296965 and 2003-15498 were made in order to solve such a problem, but further improvement is required.

SUMMARY OF THE INVENTION

The present invention has been made in view of the aforementioned problem, and has an object to provide an image forming apparatus which accurately detects that a recording material is not correctly set.

Further, another object of the present invention is to accurately detect a temperature rise at an end portion of heating means which heats a recording material even when the recording material is not correctly set to a paper feeding part in an image forming apparatus using a center of the paper feeding reference for paper feeding of the recording material.

In addition, an object of the present invention is to be able to perform control by accurately detecting a temperature rise at an end portion of heating means even in various kinds of recording materials.

Then, an object of the invention is to smoothly detect that a recording material is not correctly set to a paper feeding part so as not to cause damage to an apparatus.

An image forming apparatus according to the present invention for attaining the aforementioned objects, has a heat member for heating a recording material bearing an unfixed image thereon and is configured so that a longitudinal center of the heat member becomes a conveyance center of the recording material, the image forming apparatus including: a central portion temperature detection part disposed adjacent to the conveyance center, for controlling a temperature of the heat member to be a desired temperature; an end portion temperature detection part for detecting an end portion temperature of the heat member; and a width detection part for detecting a lateral width of the recording material, wherein the width detection part is disposed at a side opposite to a side at which the end portion temperature detection part is disposed with respect to the conveyance center position of the recording material.

Preferably, at least one width detection part is disposed within an area from the conveyance center position to an end portion of the recording material.

Preferably, a plurality of the width detection parts are disposed within an area from the conveyance center position to an end portion of the recording material, and at least one of the plurality of the width detection parts is disposed at a symmetric position with respect to the end portion temperature detection part and the conveyance center position.

Preferably, a control part for determining whether or not the recording material is correctly set based on an output of the width detection part and an output of the end portion temperature detection part is further included.

Preferably, a control part for controlling supply power for heating the heat member or a conveyance interval of the recording material, or for stopping image forming operation, based on an output of the width detection part and an output of the end portion temperature detection part is further included.

An image forming apparatus according to the present invention for attaining the aforementioned objects, has a heat member for heating a recording material bearing an unfixed image thereon and is configured so that a longitudinal center of the heat member becomes a conveyance center of the recording material, the image forming apparatus including: a central portion temperature detection part for detecting a temperature of the heat member corresponding to the conveyance center or adjacent thereto; an one side end portion temperature detection part for detecting one end portion temperature at one side in a longitudinal direction of the heat member; an another side end portion temperature detection part for detecting another end portion temperature at the other side in a longitudinal direction of the heat member; and a control part for performing device control based on heat member temperature information detected by the central portion temperature detection part, the one side end portion temperature detection part, and the other side end portion temperature detection part.

Preferably, the one side end portion temperature detection part and the other side end portion temperature detection part are disposed at an asymmetric position with respect to the conveyance center; and the control part controls the image forming apparatus based on an output of end portion temperature detection part whose temperature, detected by the one side end portion temperature detection part and the other side end portion temperature detection part, is the highest.

Preferably, the control part determines whether or not the recording material is correctly set based on outputs of the three temperature detection parts.

Preferably, the control part determines that an arrangement of the recording material at a paper feeding part is not proper when, of detection temperatures of the one side end portion temperature detection part and the end portion temperature detection part at the other side, one side detection temperature is higher than the other side detection temperature and the other detection temperature is substantially the same as a detection temperature of the central portion temperature detection part.

Preferably, the control part controls supply power for heating the heat member or a conveyance interval of the recording material, or for stopping image forming operation, based on an output of the one side or the other side end portion temperature detection part.

According to the above-configured image forming apparatus, even if a small size recording material is not set correctly in the center reference due to miss handling in setting the recording material with respect to the paper feeding part, it is possible to accurately detect the state and excessive heat at a non-paper feeding part of the heating means of a heating device can be prevented.

According to the present invention, even if the recording material is not correctly set, it is possible to accurately detect a temperature rise at an end portion.

According to the present invention, in various sizes of recording materials, it is possible to accurately detect a temperature rise at an end portion to perform control.

According to the present invention, it is possible to smoothly detect that the recording material is not correctly set so as not to cause damage to the apparatus.

Features of the present invention will become apparent from the accompanying drawings and detailed description of the invention.

DETAILED DESCRIPTION OF THE PREFERRED EMBODIMENTS

Embodiment 1

Figure 1:
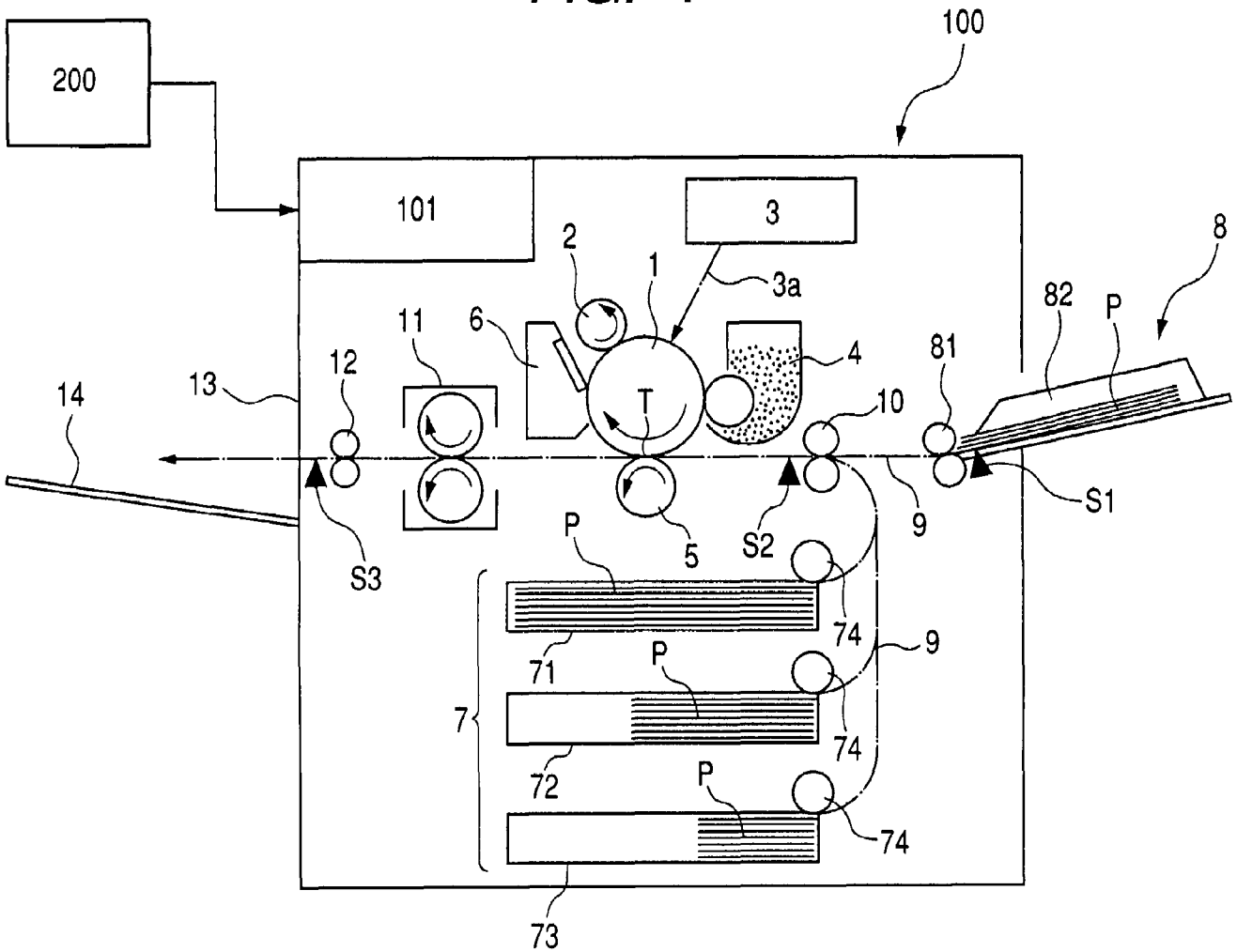
FIG. 1 is a schematic configuration view of an example of an image forming apparatus according to Embodiment 1.

FIG. 1 is a schematic configuration view of an image forming apparatus 100 according to Embodiment 1. The image forming apparatus is a laser beam printer (referred to as "printer" hereinafter) using a transfer type electrophotographic process.

The printer 100 is electrically connected to a host device 200 such as a personal computer. The printer 100 receives a print request signal from the host device 200 and image data. The image data is expanded by a printer control part 101 as control means. Then, a drum type electrophotographic photosensitive member (referred to as "photosensitive drum" hereinafter) 1 serving as an image bearing member is driven to rotate in a clockwise direction of an arrow at a predetermined speed by predetermined control timing of image forming sequence control by the printer control part 101. Further, a laser scanner 3 which is an exposure device is driven.

The photosensitive drum 1 is uniformly charged to be predetermined polarity and potential by a contact charging roller 2 serving as an electrostatic charging device while in its rotation process. Then, the thus-uniformly charged surface of the photosensitive drum 1 is scanned and exposed by a laser beam 3*a* output by being modulated in response to the above-mentioned expanded image data by the laser scanner 3, thereby forming an electrostatic latent image corresponding to the image data on the surface of the photosensitive drum 1. The electrostatic latent image is developed as a toner image by a development device 4.

On the other hand, one sheet of recording material (recording paper) P is separated and fed from a cassette paper feeding part 7 or a paper feeding tray (MP tray: multiple purpose tray) 8 by predetermined control timing to be transported to a pair of registration rollers 10 by a sheet path (a recording material conveyance path) 9. The pair of registration rollers 10 performs skew feed correction of a recording material P by once taking the recording material P at a nip portion in a rotation stop control state, and is driven to rotate by the predetermined control timing to feed the recording material P to a transferring nip portion T which is an abutting portion of the photosensitive drum 1 and the transferring roller 5.

The reference character S2 is a top sensor which is placed in a sheet path portion between the pair of registration rollers 10 and the transferring nip portion T to detect a leading edge of the recording material P fed to the transferring nip portion T by the pair of registration rollers 10. The printer control part 101 controls image writing timing or the like with respect to the photosensitive drum 1 based on a leading edge detection signal of the recording material detected by the top sensor S2.

The recording material P fed to the transferring nip portion T is transported while being held in sandwiched relation at the transferring nip portion T. During that time, transferring bias having polarity opposite to charged polarity of toner is applied to the transferring roller 5, whereby a toner image on the surface of the photosensitive drum is electrostatically transferred in series on a surface of the recording material P. The surface of the photosensitive drum after transferring the toner image to the recording material P is subject to removal of a transfer residual toner, paper powder, or the like by a cleaning device 6 to be taken for image forming repeatedly.

The recording material P onto which the toner image is transferred at the transferring nip portion T is introduced to a fixing device 11, where the toner image is heat-fixed to the recording material. The recording material P come out from the fixing device 11 is transited through paper discharge rollers 12 to be discharged from a paper discharge opening 13 to a paper discharge tray 14 as a handout. The reference character S3 is a paper discharge sensor which is placed at a portion of the paper discharge opening 13. The printer control part 101 confirms whether or not the recording material P is discharged outside the printer by a recording material presence or absence detection signal from the paper discharge sensor S3.

In the printer 100 of this embodiment, the cassette paper feeding part 7 is provided with a first to third paper feeding cassettes 71 to 73, which are selectively used. The recording material P of respective different sizes is contained in a stack in each of the paper feeding cassettes. A paper feeding roller 74 of the paper feeding cassette, which contains the recording material P of a size selectively designated by the host device 200, is driven to separate and feed one sheet of the recording material P from the paper feeding cassette. Further, when paper feeding from the paper feeding tray 8 is selectively designated, a paper feeding roller 81 of the paper feeding tray is driven to separate and feed one sheet of the recording material P set on the paper feeding tray 8.

The cassette paper feeding part 7 performs paper feeding of mainly standard plain paper as the recording material P. The paper feeding tray 8 performs paper feeding of mainly special sheets as the recording material P, for example, narrow width postcards and envelopes, standard or non-standard thick letters, and OHP sheets. Needless to say, paper feeding of standard plain paper can be performed.

In such a printer 100, paper feeding reference of the recording material P is a center of the paper feeding reference whose reference is a center of the recording material, which is used for paper feeding and conveyance from both the cassette paper feeding part 7 and the paper feeding tray 8.

Figure 2:
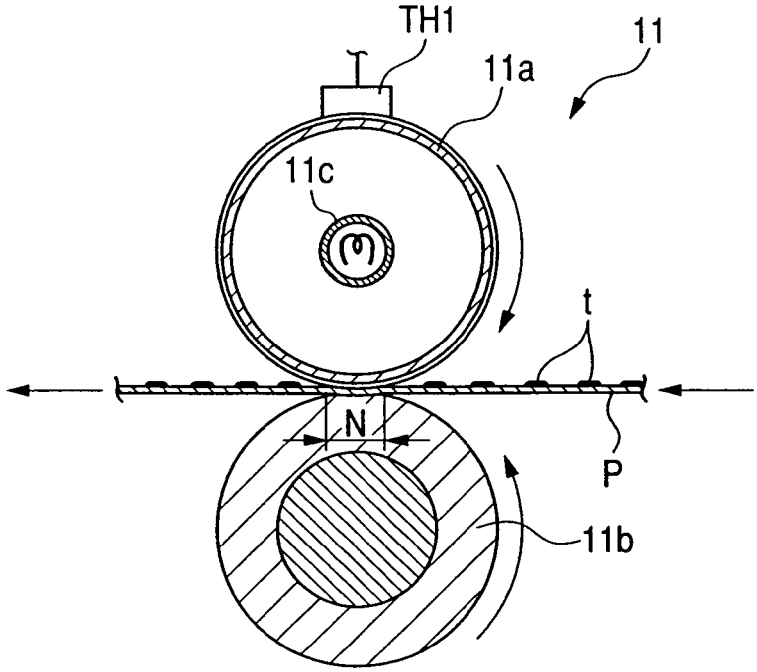
FIG. 2 is a transversal side view of an essential portion of a fixing device according to Embodiment 1.
Figure 3:
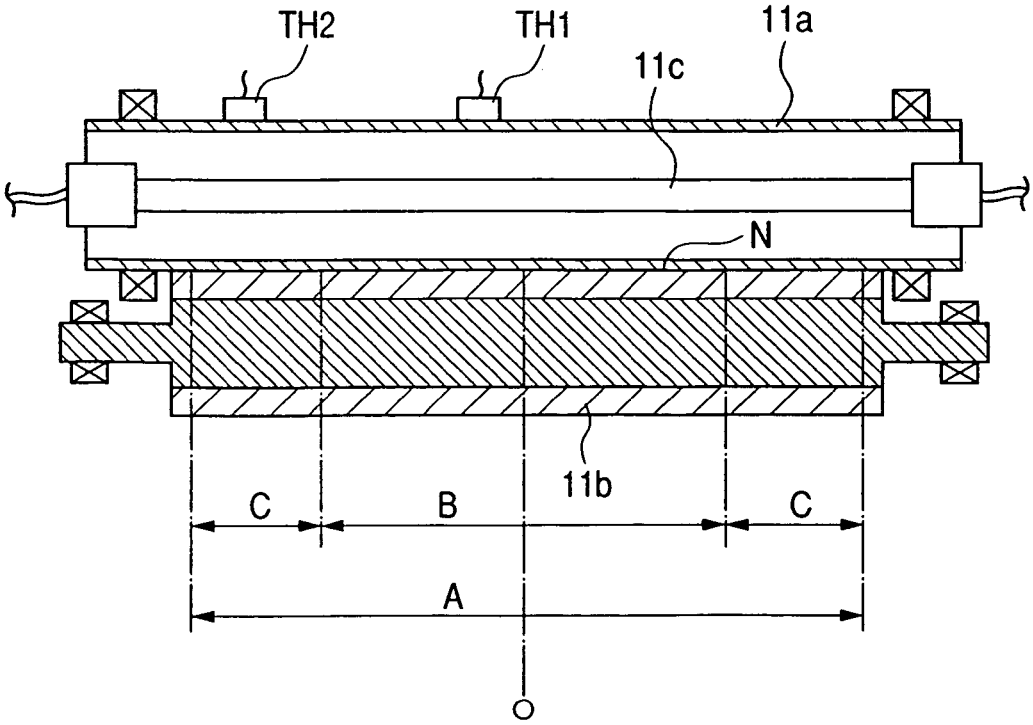
FIG. 3 is a longitudinal front view of an essential portion of the fixing device according to Embodiment 1.

The fixing device 11 in this embodiment is a heating device of a heat roller system. FIG. 2 is a transversal side view of an essential portion of the fixing device 11 and FIG. 3 is a longitudinal front view of an essential portion thereof. The fixing device 11 is basically configured by a fixing roller (a heat roller) 11*a* serving as heating means and a pair of parallel press-contacting rollers with an elastic pressure roller serving as pressure means; the pair of rollers are rotated; the recording material P, having an unfixed toner image t formed and borne on the fixing nip portion N which is a mutual press-contacting portion of the pair of rollers, is introduced to be transported in sandwiched relation; and the unfixed toner image t is hot pressed to be fixed to the surface of the recording material by heat of the fixing roller 11*a* and pressurizing force of the fixing nip portion N.

The fixing roller 11*a* has a hollow rigid roller made of metal such as aluminum, serving as a base; a toner release layer such as fluorine resin is coated on the surface thereof; and a halogen heater 11*c* serving as a heat source is inserted and placed at the inside thereof. The fixing roller 11*a* is heated from the inside due to heat generation of the heater by supplying electric power to the halogen heater 11*c*. The pressure roller 11*b* is composed of a metal cored bar, for example, iron and a heat resistance elastic layer formed around the metal cored bar for maintaining a predetermined width of the fixing nip portion.

Here, a paper width denotes a recording material size in a direction intersecting with the conveyance direction of the recording material in the plane of the recording material. As mentioned before, the recording material paper feeding of the printer 100 of this embodiment is the center reference of the recording material center. In FIG. 3, the reference character O denotes of a center of the paper feeding reference line (virtual line) of its recording material. The reference character A denotes a paper feeding area width of the recording material having the maximum paper width capable of paper feeding for the printer 100. A recording material with a paper width corresponding to the paper feeding area width A is designated as a large size recording material. The reference character B denotes a paper feeding area width of the recording material with a paper width smaller than the paper width of the large size recording material. A recording material with a paper width smaller than the paper width of the large size recording material is designated as a small size recording material. The reference character C denotes a difference area width between the large size recording material paper feeding area width A and the small size recording material paper feeding area width B. That is, it is a non-paper feeding area width which appears in the surface of the recording material conveyance path of the printer when the small size recording material is fed. Since the recording material paper feeding is based on the center reference, the non-paper feeding area when the small size recording material is fed appears on both right and left sides of the small size recording material paper feeding area width B. Then, the non-paper feeding area width C differs in accordance with many sizes of the paper width of the fed small size recording material.

The reference characters TH1 and TH2 are central portion temperature detection part(means) and end portion temperature detection part(means) for respectively detecting a surface temperature at a substantially central portion and a surface temperature at an end portion in a longitudinal direction (a direction intersecting with the conveyance direction of the recording material in the surface of the recording material conveyance path) of the fixing roller 11*a*. The respective temperature detection elements such as a thermister are placed in contact with or near and in noncontact with the surface of the fixing roller.

The central portion temperature detection part TH1 serving as temperature control of the fixing roller 11*a* is disposed in response to a position (near the position of the center of paper feeding reference line of the recording material) in a substantially longitudinal center portion of the fixing roller which becomes a recording material paper feeding area even a recording material with any paper width of many sizes is fed. The printer control part 101 controls a fixing roller surface temperature of the recording material paper feeding area to be a desired set fixing temperature by controlling supply power from a power supply part (not shown) to the halogen heater 11*c* so that fixing roller surface temperature information input from the central portion temperature detection part TH1 is maintained to respond to a predetermined set fixing temperature.

The end portion temperature detection part TH2 as a temperature rise monitoring at a non-paper feeding part of the fixing roller 11*a* is disposed in response to an end portion position on one side of the area width within a area width of the large size recording material paper feeding area width A. When the small size recording material is continuously fed, a temperature at a portion corresponding to the small size recording material paper feeding area width B of the fixing roller 11*a* is maintained at a desired fixing temperature by temperature control by using the central portion temperature detection part TH1; however, a portion corresponding to the non-paper feeding area width C of the fixing roller 11*a* accumulates heat because the heat is not consumed due to heating of the recording material, thereby gradually increasing in temperature to be higher than a predetermined fixing temperature (non-paper feeding part temperature rise). The end portion temperature detection part TH2 detects the temperature of the non-paper feeding part temperature rise. The printer control part 101 performs controls supply power to the halogen heater 11*c* which is a fixing roller heat source or changing a conveyance time interval (a continuous printing interval, throughput) of the recording material so that a temperature at the portion corresponding to the non-paper feeding area width C of the fixing roller 11*a* becomes not more than a predetermined allowable temperature based on the temperature of the non-paper feeding part temperature rise input from the end portion temperature detection part TH2.

Figure 4:
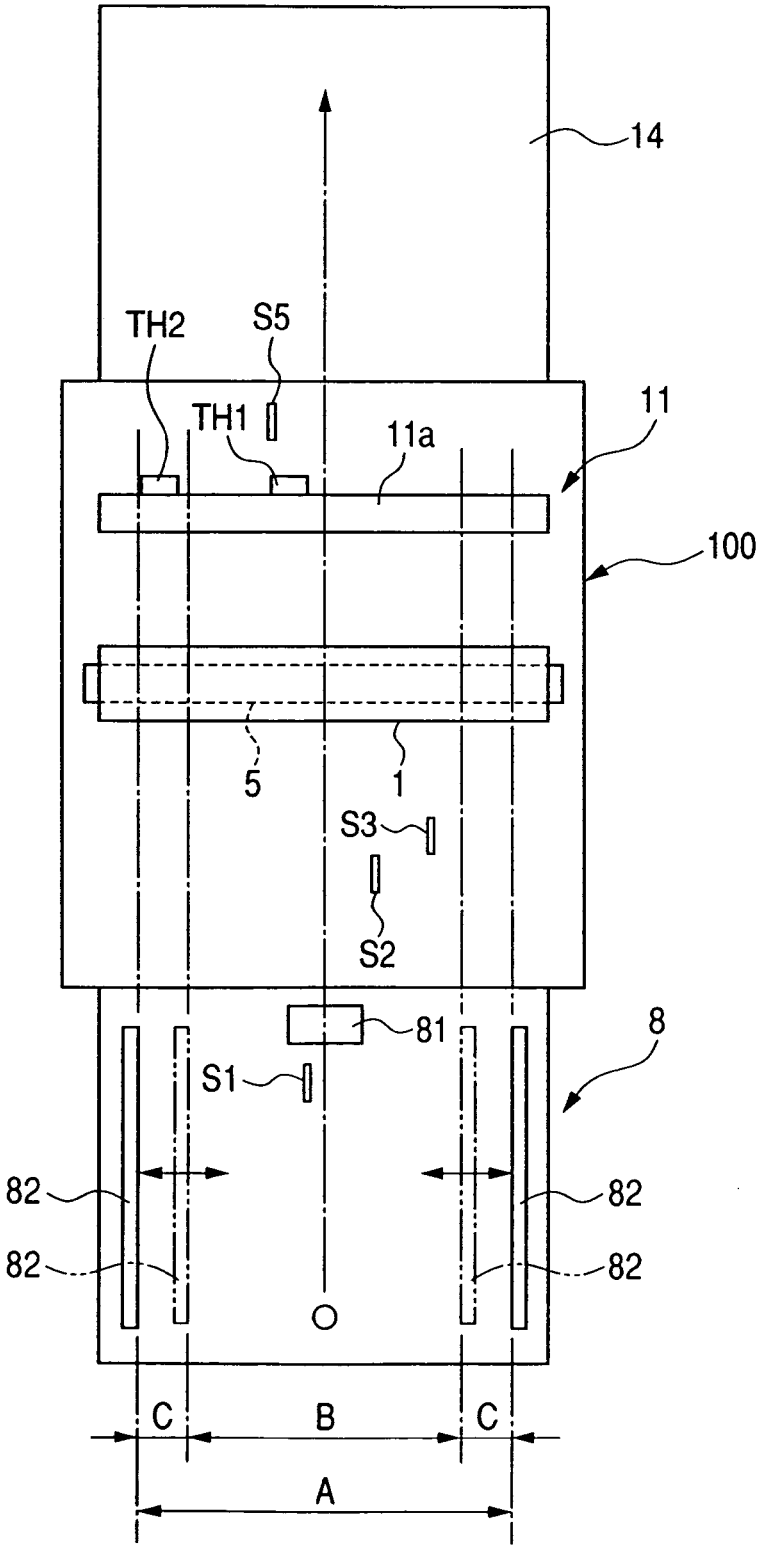
FIG. 4 is a schematic development plan view of a recording material conveyance path from a paper feeding tray to a paper discharge tray.
Figure 5:
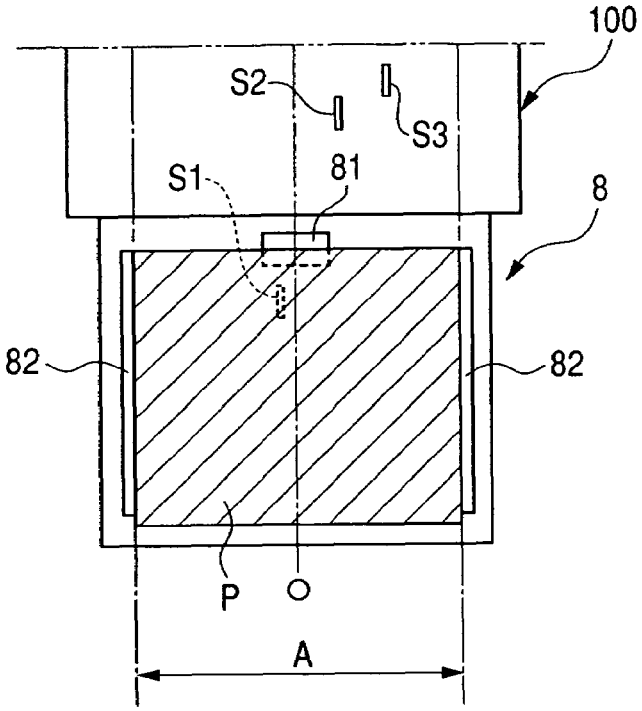
FIG. 5 is a plan view in which a large size recording material is set to the paper feeding tray.
Figure 6:
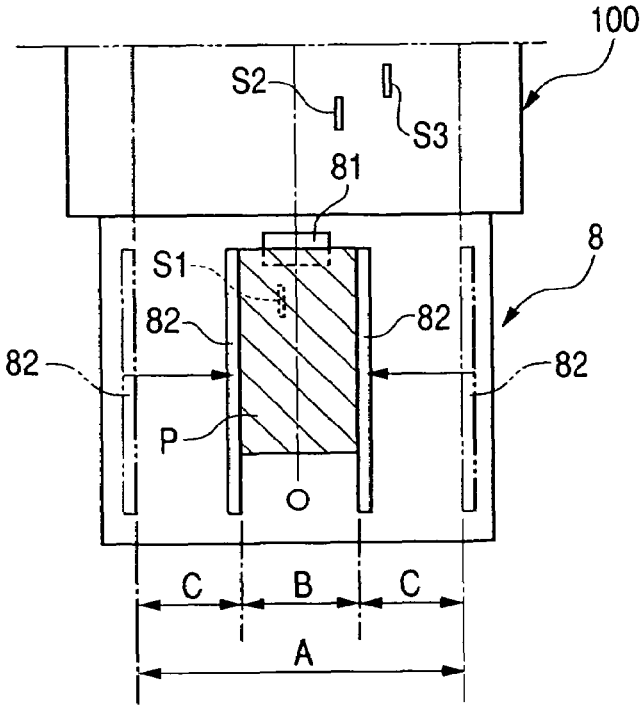
FIG. 6 is a plan view in which a small size recording material is set in center conveyance reference with respect to the paper feeding tray.

FIG. 4 is a schematic development plan view of the recording material conveyance path from the paper feeding tray 8 of the printer 100 to the paper discharge tray 14. In the paper feeding tray 8, the reference numerals 82 are a pair of left and right recording material side regulation plates (referred to as "a regulation plate" hereinafter) disposed on the paper feeding tray 8. The regulation plates 82 are slidably movable in parallel to the left and the right on the paper feeding tray 8; and when one of the regulation plates is moved to the left and the right, the other regulation plate moves in the opposite direction in conjunction with the former regulation plate movement, whereby a space between the both regulation plates can be adjusted narrowly or widely in the center reference. While the space between the regulation plates 82 is spread, the recording material P is placed on the paper feeding tray 8 therebetween and the regulation plates 82 are narrowed in accordance with a width of the recording material P. By this operation, the left and the right sides of the recording material P are regulated between inner sides of the left and the right regulation plates 82, and therefore, the recording material P is set on the paper feeding tray 8 so that the paper width center substantially conforms to a center line of the paper feeding reference O. FIG. 5 shows a state that the large size recording material P is set. FIG. 6 shows a state that the small size recording material P is set.

The reference character S1 denotes a presence or absence sensor (a paper presence or absence sensor) of the recording material P in the paper feeding tray 8. The recording material presence or absence sensor S1 is disposed at a position nearer a center line of the paper feeding reference of the recording material in a leading edge side of the paper feeding tray 8 and a front side of the paper feeding roller 81. The presence of the recording material can be detected by the recording material presence or absence sensor S1 when the large size recording material and the small size recording material are correctly set on the paper feeding tray 8 in the center reference. Recording material presence or absence detection information by the sensor S1 is input to the printer control part 101.

When paper feeding from the paper feeding tray 8 is selected, the printer control part 101 confirms the presence or absence of the recording material on the paper feeding tray 8 by the sensor S1, permits paper feeding operation driven by the paper feeding roller 81 when the presence of the recording material is confirmed, prohibits print operation of the printer 100 when the absence of the recording material is confirmed, and indicates a warning of the absence of the recording material on the host device 200.

When the recording material presence or absence sensor detects the presence of the recording material, when the paper feeding roller 81 is driven, the recording material P on the paper feeding tray 8 is fed inside the printer 100 in the center reference and print operation with respect to the recording material is carried out as in the above-mention.

Further, the before-mentioned top sensor S2 and the paper discharge sensor S3 are disposed at a position nearer the center line of the paper feeding reference so as to detect the recording material with any paper width of many sizes, being set on the paper feeding tray 8 and fed in the center reference.

However, in the case of feeding the recording material from the cassette paper feeding part 7, the large size recording material and the small size recording material are almost certainly fed and transported in the center reference. However, in the case of feeding paper from the paper feeding tray 8, there is a possible situation in which the small size recording material is not often correctly set on the paper feeding tray 8. By this, there is a possibility that the small size recording material is fed and transported to inside the printer like one side paper feeding reference conveyance in lateral deviation from the center line O of the paper feeding reference.

That is, regarding the setting of the recording material P to the paper feeding tray 8, as described above, while the space between the regulation plates 82 is spread, the recording material P is placed on the paper feeding tray 8 therebetween; then, the regulation plates 82 are narrowed in accordance with a width of the recording material P. By this operation, the left and the right sides of the recording material P are regulated between inner sides of the left and the right regulation plates 82 to set so that the paper width center substantially conforms to the center line O of the paper feeding reference. However, in the setting of the small size recording material, for example, in a state that a side of the recording material is put into contact with one of the inner side of the left and the right regulation plates 82 which are spread large as shown in FIG. 7 to FIG. 10, there is a possible case in which the left and the right regulation plates 82 are not narrowed in accordance with the paper width of the recording material P. In this case, the small size recording material is offset to the left side or the right side on the paper feeding tray 8 as in the case of the paper feeding tray of the one side reference conveyance.

Figure 7:
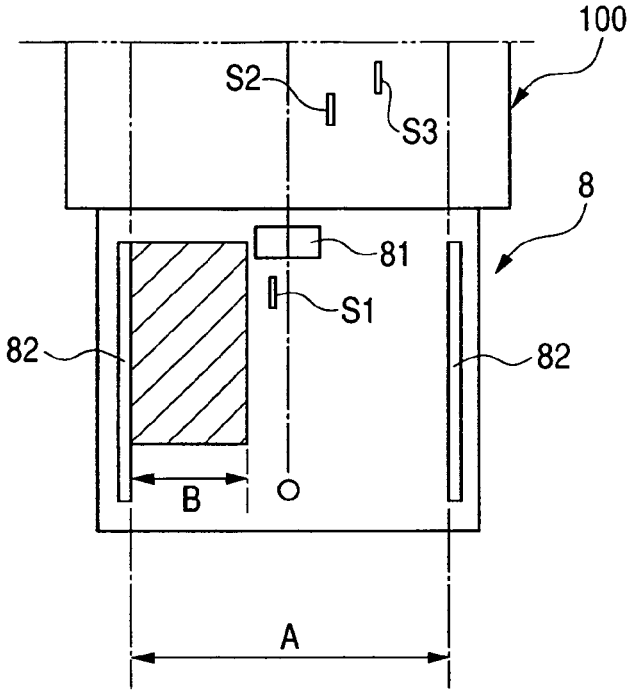
FIG. 7 is a plan view of a state in which the small size recording material is not correctly set to the paper feeding tray (a first state).
Figure 8:
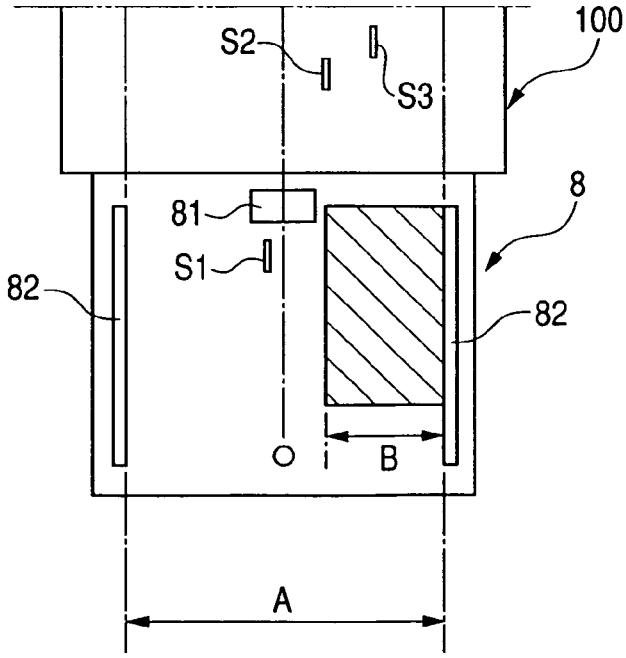
FIG. 8 is a plan view of a state in which the small size recording material is not correctly set to the paper feeding tray (a second state).

In an offset state of the small size recording material, when the recording material P in the offset state as shown in FIG. 7 and FIG. 8 does not cover over the position of the recording material presence or absence sensor S1 on the paper feeding tray 8 due to a relatively small paper width of the recording material P, the printer control part 101 prohibits print operation of the printer 100 and makes the host device 200 indicate a warning of the absence of the recording material because the sensor S1 detects the absence of the recording material even paper feeding from the paper feeding tray 8 is selected. Operators notice a setting error of the recording material by watching the state of the paper feeding tray 8 according to the warning indication.

Figure 19:
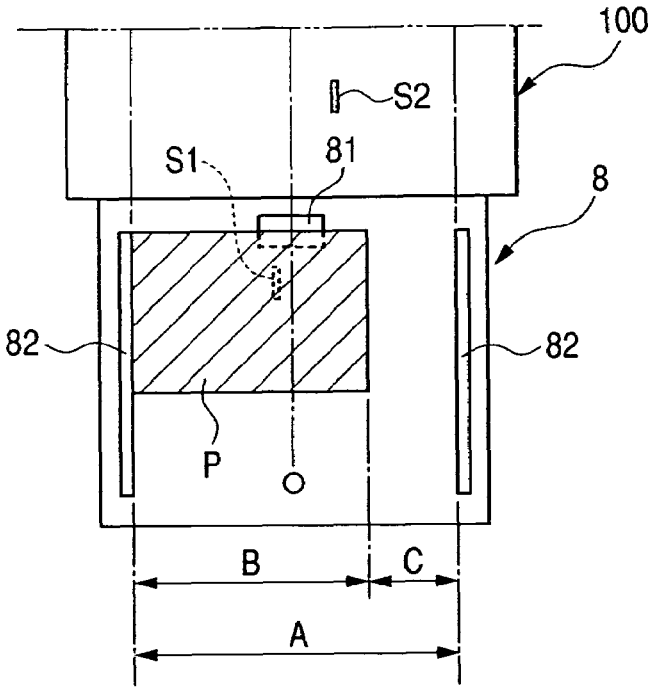
FIG. 19 is a plan view of a state in which the small size recording material is not correctly set to the paper feeding tray (a third state).
Figure 20:
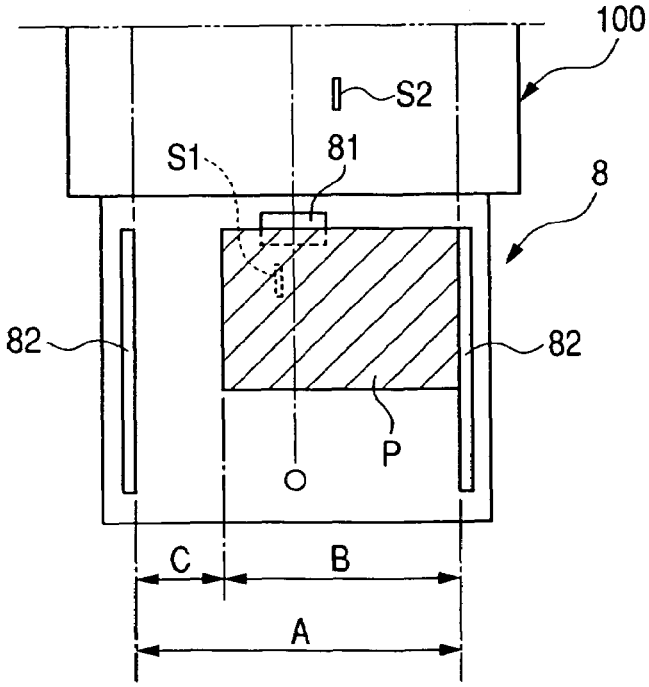
FIG. 20 is a plan view of a state in which the small size recording material is not correctly set to the paper feeding tray (a fourth state).

However, when the recording material P covers over the position of the recording material presence or absence sensor S1 as shown in FIG. 19 and FIG. 20 in the offset state of the recording material because the paper width is relatively large even in the small size recording material, the sensor S1 detects the presence of the recording material. Therefore, in this case, when paper feeding from the paper feeding tray 8 is selected, since the sensor S1 detects the presence of the recording material, the printer control part 101 permits paper feeding operation driven by the paper feeding roller 81 and executes print operation of the printer 100. However, formation of a toner image with respect to the photosensitive drum 1 is performed in response to the center reference conveyance of the recording material, whereas, an actual recording material fed and transported to inside the printer is in a state of the left or the right deviation from the center line O of the paper feeding reference, and therefore, images formed on the recording material become an image with lateral deviation or a defective image. Operators notice a setting error of the recording material by watching the image defect (misprint).

Figure 9:
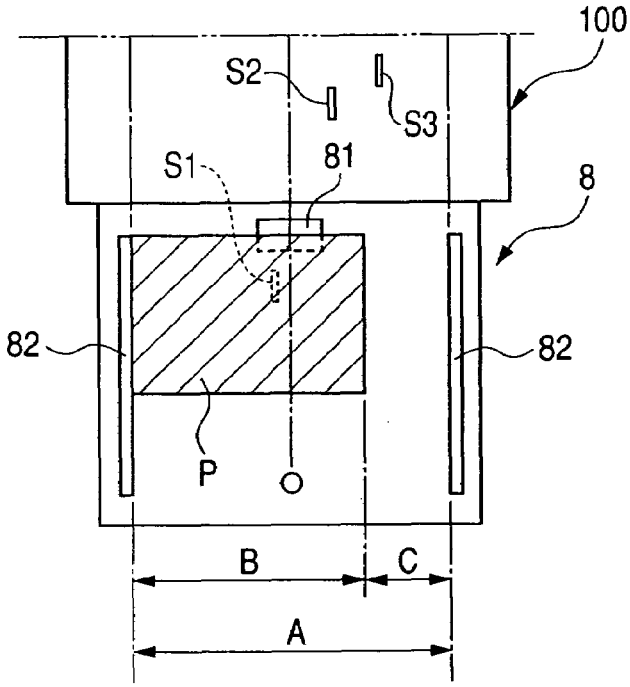
FIG. 9 is a plan view of a state in which the small size recording material is not correctly set to the paper feeding tray (a third state).

Further, as shown in FIG. 9, of the left and the right regulation plates 82 of the paper feeding tray 8, when the small size recording material is offset to the regulation plate 82 on the side that is the same as the side in which the end portion temperature detection part TH2 is provided in the fixing device 11, the end portion temperature detection part TH2 is covered over with the paper feeding area width B of the small size recording material. Therefore, a non-paper feeding part temperature rise of the fixing roller end portion by the end portion temperature detection part TH2 during the continuous paper feeding of the small size recording material cannot be detected at all. Consequently, although the small size recording material is actually continuously fed and transported, the printer control part 101 performs a printer control as when the large size recording material is fed and transported, which doe not generate a non-paper feeding part temperature rise. As a result, a fixing roller portion, corresponding to the non-paper feeding area width C which appears on the end portion side opposite to the end portion side provided with the end portion temperature detection part TH2 of the fixing roller 11*a*, may have a non-paper feeding part temperature rise and uncontrollably raises temperature to be an excessively heated state as the small size recording material is continuously fed and transported.

Figure 10:
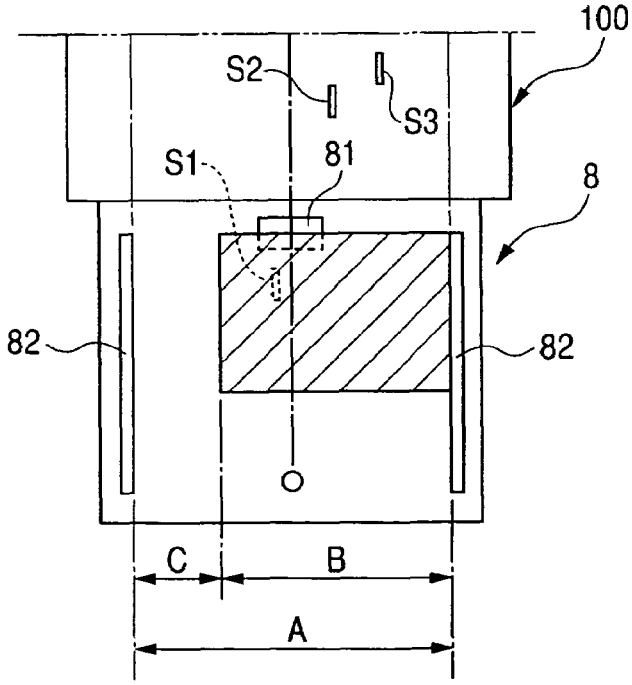
FIG. 10 is a plan view of a state in which the small size recording material is not correctly set to the paper feeding tray (a fourth state).

As shown in FIG. 10, when the small size recording material is offset to the regulation plate 82 on the side opposite to the fixing roller end portion side in which the end portion temperature detection part TH2 is provided, since the end portion temperature detection part TH2 is not covered within the paper feeding area width B of the small size recording material, the non-paper feeding part temperature rise of the fixing roller end portion by the end portion temperature detection part TH2 during the continuous paper feeding of the small size recording material can be detected. The printer control part 101 controls supply power to the halogen heater 11*c* which is a fixing roller heat source or changing a conveyance time interval of the recording material so that a temperature at the portion corresponding to the non-paper feeding area width C of the fixing roller 11*a* becomes not more than a predetermined allowable temperature based on the temperature of the non-paper feeding part temperature rise input from the end portion temperature detection part TH2. Therefore, the excessively heated state at the non-paper feeding part of the fixing roller 11*a* as in the case of FIG. 9 can be avoided.

Therefore, in order to prevent the excessively heated state at the non-paper feeding part of the fixing roller 11*a* as in the case of FIG. 9, in this embodiment, as shown in FIG. 1 and FIG. 4, a width detection part (paper width detection part) S3 for detecting a horizontal width of the recording material is disposed on the side opposite to the side in which the end portion temperature detection part TH2 is disposed at the fixing device 11, with respect to the position of the center line O of the paper feeding reference which is the recording material paper feeding reference position, in a crossing direction of the sheet path portion between the pair of registration rollers 10 and the transferring nip portion T. The width detection part S3 is a recording material presence or absence detection sensor.

Then, as shown in FIG. 9, when the small size recording material is offset along the regulation plate 82 on the side of the end portion temperature detection part TH2, and when the small size recording material is continuously fed in this state, if the non-paper feeding part temperature rise of the fixing roller end portion by the end portion temperature detection part TH2 at the printer control part 101 is not detected, since the width detection part S3 is not covered by the small size recording material P being transported, the printer control part 101 recognizes that the recording material being fed by the recording material absence detection signal from the width detection part S3 is the small size recording material.

The printer control part 101 controls supply power to the halogen heater 11*c* which is a fixing roller heat source or changing a conveyance time interval of the recording material so that a temperature at the portion corresponding to the non-paper feeding area width C of the fixing roller 11*a* becomes not more than a predetermined allowable temperature based on this acknowledgment. Therefore, the excessively heated state at the non-paper feeding part of the fixing roller 11*a* can be avoided. In this regard, the printed out material seemed like an image with lateral deviation or a defective image is a misprint.

Alternatively, in a continuous paper feeding mode of the recording material from the paper feeding tray 8, and when the end portion temperature detection part TH2 does not detect the non-paper feeding part temperature rise of the fixing roller end portion and the input signal from the width detection part S3 is the recording material absence detection signal, the printer control part 101 recognizes that the small size recording material is not correctly set on the paper feeding tray 8 in the center conveyance reference, immediately stops image forming operation of the printer, and indicates the warning of that effect on the host device 200, whereby the excessively heated state of the non-paper feeding part of the fixing roller 11*a* can be prevented. Further, in this case, misprint inputs that follow are prevented by stopping image forming operation of the printer.

Embodiment 2

Figure 11:
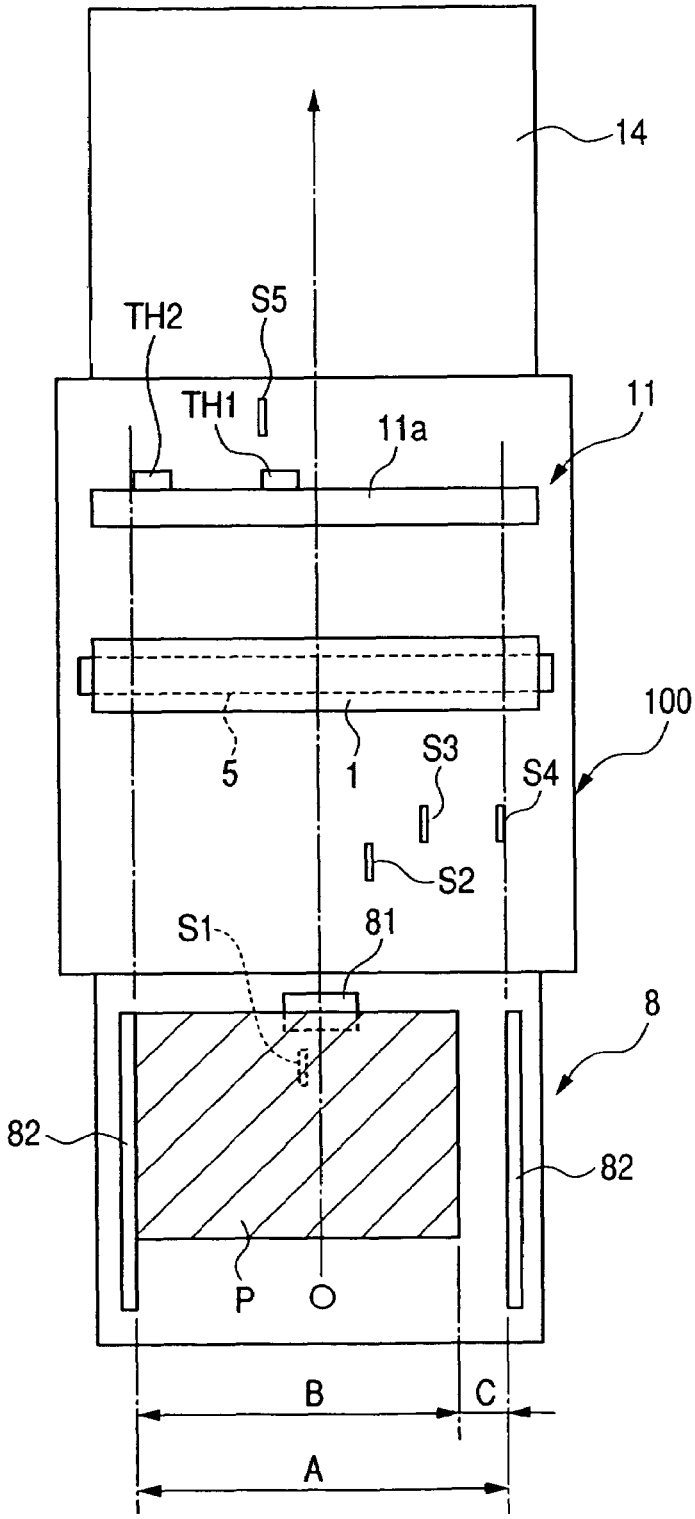
FIG. 11 is a schematic development plan view of a recording material conveyance path from a paper feeding tray to a paper discharge tray of an example of an image forming apparatus according to Embodiment 2.

FIG. 11 is an explanatory view of Embodiment 2. FIG. 11 is a schematic development plan view of the recording material conveyance path from the paper feeding tray 8 of the printer 100 to the paper discharge tray 14, as in FIG. 4 of the printer of Embodiment 1. Configuration members and portions that are similar to those of the printer of Embodiment 3 are given by the same the reference numerals/characters and their description will not be repeated.

The width detection part S4 is a second width detection part which is further added in Embodiment 2 other than the width detection part S3 as the first width detection part. The second width detection part S4 is also disposed on the side opposite to the side in which the end portion temperature detection part TH2 is disposed in the fixing device 11 with respect to the center line O of the paper feeding reference which is the recording material paper feeding reference position and is disposed at a symmetric position on the other side of the end portion temperature detection part TH2 with respect to the position of the center line O of the paper feeding reference.

When the small size recording material is offset along the regulation plate 81 on the side of the end portion temperature detection part TH2 and the paper width of the small size recording material has a size that cover a first width detection part S3, the recording material fed by the second width detection part S4 is detected as the small size recording material. That is, when the small size recording material is continuously fed in the set state of FIG. 11, if the non-paper feeding part temperature rise of the fixing roller end portion by the end portion temperature detection part TH2 at the printer control part 101 is not detected, since the second width detection part S4 is not covered by the recording material P being transported though presence of the recording material is detected because the first width detection part S3 is covered by the recording material P being transported, the printer control part 101 recognizes that the recording material being fed by the recording material absence detection signal from the second width detection part S4 is the small size recording material.

The printer control part 101 controls supply power to the halogen heater 11*c* which is a fixing roller heat source or changing a conveyance time interval of the recording material so that a temperature at the portion corresponding to the non-paper feeding area width C of the fixing roller 11*a* becomes not more than a predetermined allowable temperature based on this acknowledgment. Therefore, the excessively heated state at the non-paper feeding part of the fixing roller 11*a* can be avoided.

Alternatively, in a continuous paper feeding mode of the recording material from the paper feeding tray 8, and when the end portion temperature detection part TH2 does not detect the non-paper feeding part temperature rise of the fixing roller end portion and the input signal from the second width detection part S4 is the recording material absence detection signal, the printer control part 101 recognizes that the small size recording material is not correctly set on the paper feeding tray 8 in the center conveyance reference, immediately stops image forming operation of the printer, and indicates the warning of that effect on the host device 200, whereby the excessively heated state of the non-paper feeding part of the fixing roller 11*a* can be prevented.

For example, there are many applicable paper feeding widths because a A4-size paper is generally transversely fed in a machine for A3-size, so that only one width detection part is insufficient to cover all such paper feeding widths. Therefore, in this embodiment, the first width detection part S3 and the second width detection S4 are provided. In the case of the large size recording material, both the first width detection part S3 and the second width detection S4 are covered by the recording material P. As described above, the width detection parts S3 and S4 are provided, whereby detection can be certainly performed in image forming apparatuses especially capable of feeding A3-size or larger paper, even in an apparatus capable of feeding the recording material of many different sizes.

Embodiment 3

Figure 12:
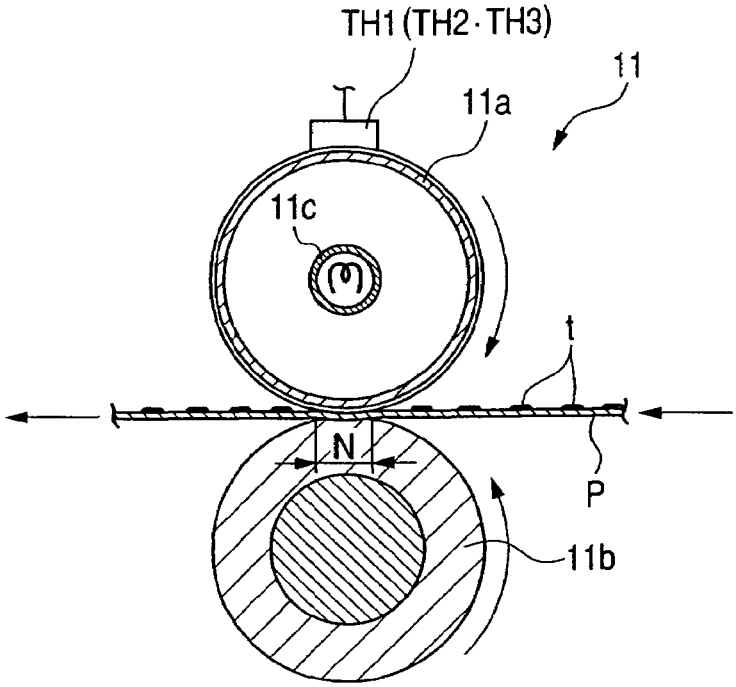
FIG. 12 is a transversal side view of an essential portion of a heating device according to Embodiment 3.
Figure 13:
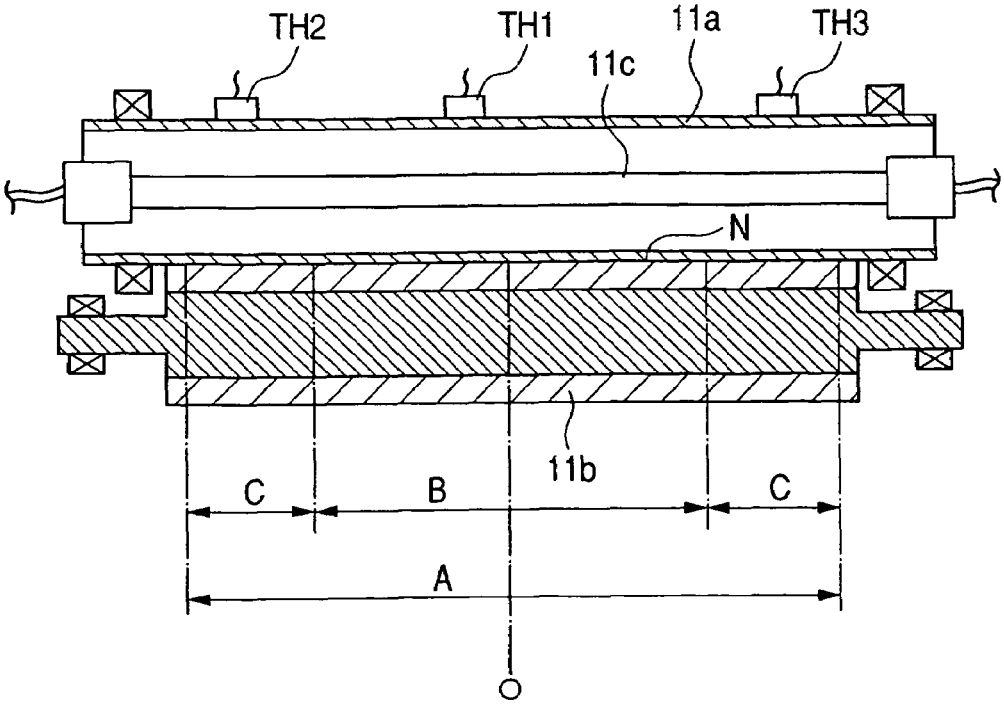
FIG. 13 is a longitudinal front view of an essential portion of the heating device according to Embodiment 3.

The fixing device 11 in this embodiment is a heating device of a heat roller system. FIG. 12 is a transversal side view of an essential portion of the fixing device 11 and FIG. 13 is a longitudinal front view of an essential portion thereof. The fixing device 11 is basically configured by a fixing roller (a heat roller) 11*a* serving as heating means and a pair of parallel press-contacting rollers with an elastic pressure roller serving as pressure means; the pair of rollers are rotated; the recording material P, having an unfixed toner image t formed and borne on the fixing nip portion N which is a mutual press-contacting portion of the pair of rollers, is introduced to be transported in sandwiched relation; and the unfixed toner image t is hot pressed to be fixed to the surface of the recording material by heat of the fixing roller 11*a* and pressurizing force of the fixing nip portion N.

The fixing roller 11*a* has a hollow rigid roller made of metal such as aluminum, serving as a base; a toner release layer such as fluorine resin is coated on the surface thereof; and a halogen heater 11*c* serving as a heat source is inserted and placed at the inside thereof. The fixing roller 11*a* is heated from the inside due to heat generation of the heater by supplying electric power to the halogen heater 11*c*. The pressure roller 11*b* is composed of a metal cored bar, for example, iron and a heat resistance elastic layer formed around the metal cored bar for maintaining a predetermined width of the fixing nip portion.

Here, a paper width denotes a recording material size in a direction intersecting with the conveyance direction of the recording material in the plane of the recording material. As mentioned before, the recording material paper feeding of the printer 100 of this embodiment is the center paper feeding reference of the recording material center. In FIG. 13, the reference character O denotes its recording material center paper feeding reference line (virtual line). The reference character A denotes a paper feeding area width of the recording material having the maximum paper width capable of paper feeding for the printer 100. A recording material with a paper width corresponding to the paper feeding area width A is designated as a large size recording material. The reference character B denotes a paper feeding area width of the recording material with a paper width smaller than the paper width of the large size recording material. A recording material with a paper width smaller than the paper width of the large size recording material is designated as a small size recording material. The reference character C denotes a difference area width between the large size recording material paper feeding area width A and the small size recording material paper feeding area width B. That is, it is a non-paper feeding area width which appears in the surface of the recording material conveyance path of the printer when the small size recording material is fed. Since the recording material paper feeding is based on the center reference, the non-paper feeding area when the small size recording material is fed appears on both right and left sides of the small size recording material paper feeding area width B. Then, the non-paper feeding area width C differs in accordance with many sizes of the paper width of the fed small size recording material.

The reference characters TH1, TH2, and TH3 are central portion temperature detection part, one side end portion temperature detection part (first end portion temperature detection part), and the other side end portion temperature detection part (second end portion temperature detection part) for respectively detecting a temperature of the fixing roller 11*a* which is heating means. The three temperature detection part TH1, TH2, and TH3 have respective temperature detection elements such as a thermister, placed in contact with or near and in noncontact with the surface of the fixing roller.

The central portion temperature detection part TH1 serving as temperature control of the fixing roller 11*a* is disposed in response to a substantially central position (position corresponding to the recording material center paper feeding reference line position O or its near position) of a longitudinal direction of the fixing roller (direction intersecting with the recording material conveyance direction in the surface of the recording material conveyance path) which becomes a recording material paper feeding area even a recording material with any paper width of many sizes is fed.

The printer control part 101 as control means controls a fixing roller surface temperature of the recording material paper feeding area to be a desired set fixing temperature by controlling supply power from a power supply part (not shown) to the halogen heater 11*c* so that fixing roller surface temperature information input from the central portion temperature detection part TH1 is maintained to respond to a predetermined set fixing temperature.

The one side end portion temperature detection part TH2, serving as temperature rise monitoring at the non-paper feeding part of the fixing roller 11*a*, is disposed within the area width of the large size recording material paper feeding area width A so as to detect an end portion temperature of the fixing roller portion of one side based on the recording material center paper feeding reference line position O in the longitudinal direction of the fixing roller.

The other side end portion temperature detection part TH3, serving as temperature rise monitoring at the non-paper feeding part of the fixing roller 11*a*, is also disposed within the area width of the large size recording material paper feeding area width A so as to detect an end portion temperature of the fixing roller portion of the other side based on the recording material center paper feeding reference line position O in the longitudinal direction of the fixing roller.

In this embodiment, the one side end portion temperature detection part TH2 and the other side end portion temperature detection part TH3 are disposed at symmetric positions with respect to the recording material center paper feeding reference line position O.

When the small size recording material is continuously fed, a temperature at a portion corresponding to the small size recording material paper feeding area width B of the fixing roller 11*a* is maintained at a desired fixing temperature by temperature control by using the central portion temperature detection part TH1; however, a portion corresponding to the non-paper feeding area width C of the fixing roller 11*a* accumulates heat because the heat is not consumed due to heating of the recording material, thereby gradually increasing in temperature to be higher than a predetermined fixing temperature (non-paper feeding part temperature rise). The above-mentioned one side end portion temperature detection part TH2 and the other side end portion temperature detection part TH3 detect the temperature of the non-paper feeding part temperature rise at the respective sides.

The printer control part 101 controls supply power to the halogen heater 11*c* which is a fixing roller heat source or changing a conveyance time interval (a continuous printing interval, throughput) of the recording material so that a temperature at the portion corresponding to the non-paper feeding area width C of the fixing roller 11*a* becomes not more than a predetermined allowable temperature based on non-paper feeding part temperature rise temperature information input from the one side end portion temperature detection part TH2 or the other side end portion temperature detection part TH3.

Figure 14:
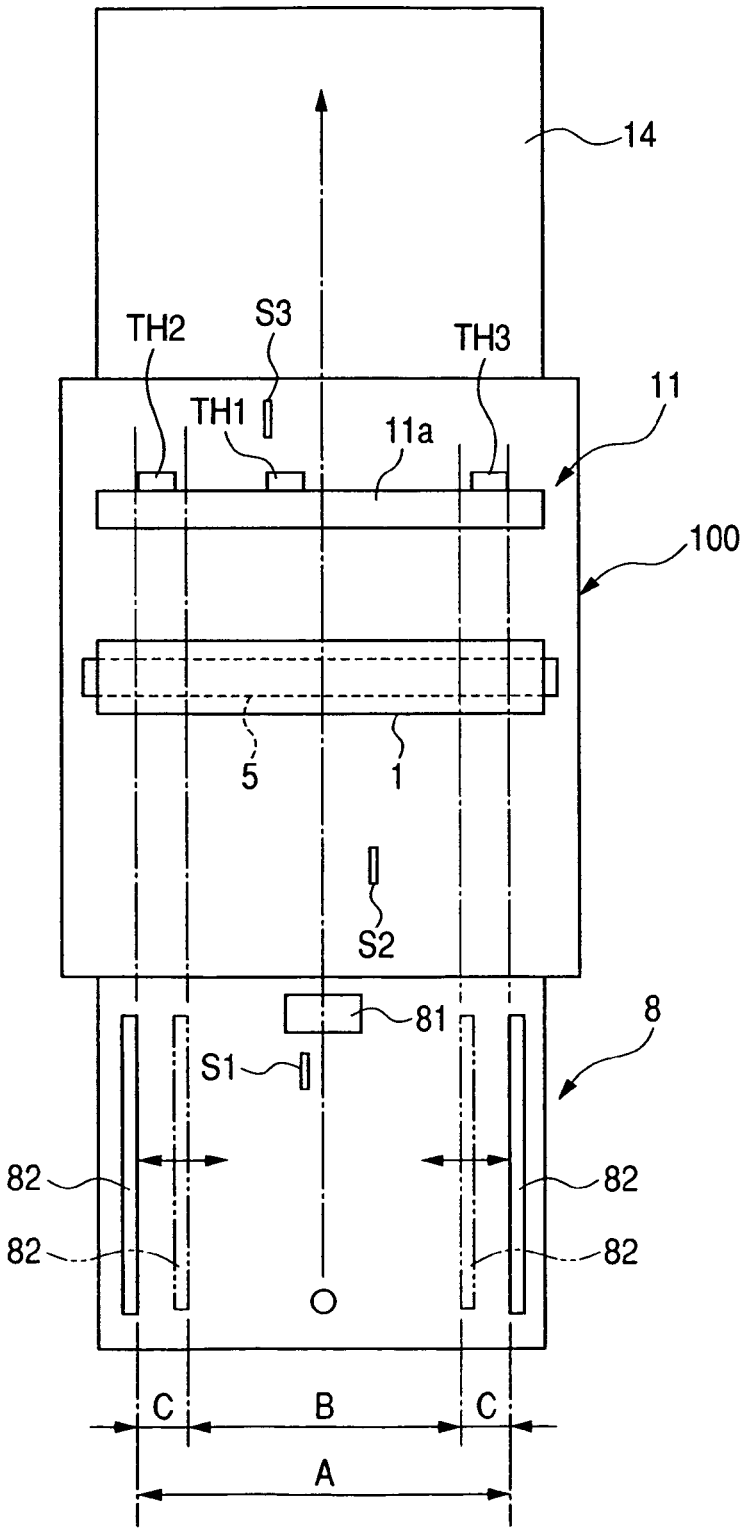
FIG. 14 is a schematic development plan view of a recording material conveyance path from a paper feeding tray to a paper discharge tray.
Figure 15:
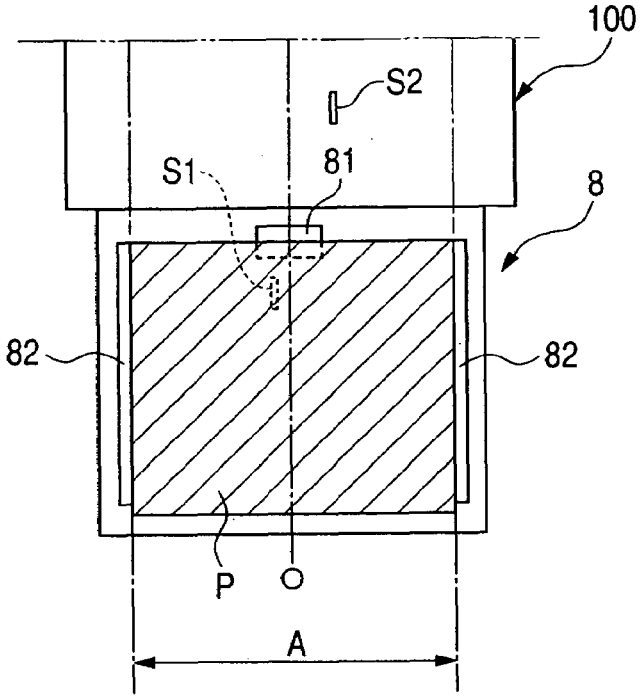
FIG. 15 is a plan view in which a large size recording material is set to the paper feeding tray.
Figure 16:
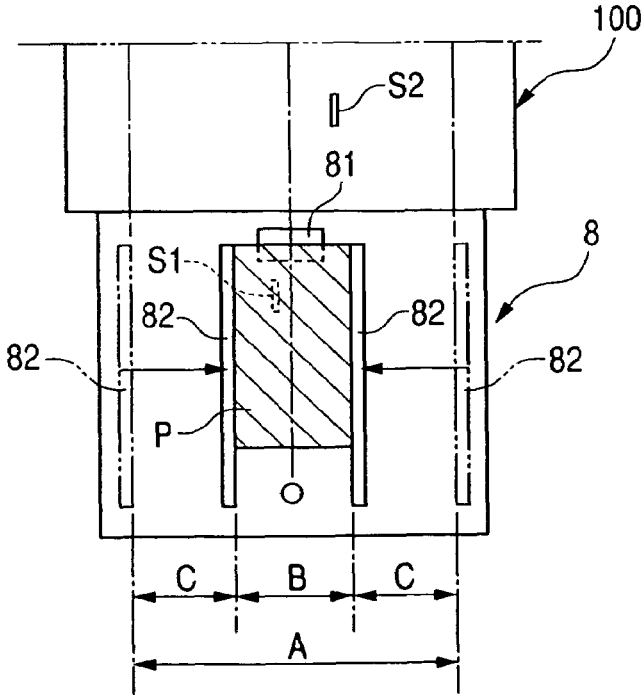
FIG. 16 is a plan view in which a small size recording material is set in center conveyance reference with respect to the paper feeding tray.

FIG. 14 is a schematic development plan view of the recording material conveyance path from the paper feeding tray 8 of the printer 100 to the paper discharge tray 14. In the paper feeding tray 8, the reference numerals 82 are a pair of left and right recording material side regulation plates (referred to as "a regulation plate" hereinafter) disposed on the paper feeding tray 8. The regulation plates 82 are slidably movable in parallel to the left and the right on the paper feeding tray 8; and when one of the regulation plates is moved to the left and the right, the other regulation plate moves in the opposite direction in conjunction with the former regulation plate movement, whereby a space between the both regulation plates can be adjusted narrowly or widely in the center reference. While the space between the regulation plates 82 is spread, the recording material P is placed on the paper feeding tray 8 therebetween and the regulation plates 82 are narrowed in accordance with a width of the recording material P. By this operation, the left and the right sides of the recording material P are regulated between inner sides of the left and the right regulation plates 82, and therefore, the recording material P is set on the paper feeding tray 8 so that the paper width center substantially conforms to a center line O of the paper feeding reference O. FIG. 15 shows a state that the large size recording material P is set. FIG. 16 shows a state that the small size recording material P is set.

The reference character S1 denotes a presence or absence sensor (a paper presence or absence sensor) of the recording material P in the paper feeding tray 8. The recording material presence or absence sensor S1 is disposed at a position nearer the recording material center paper feeding reference line in a leading edge side of the paper feeding tray 8 and a front side of the paper feeding roller 81. The presence of the recording material can be detected by the recording material presence or absence sensor S1 when the large size recording material and the small size recording material are correctly set on the paper feeding tray 8 in the center reference. Recording material presence or absence detection information by the sensor S1 is input to the printer control part 101.

When paper feeding from the paper feeding tray 8 is selected, the printer control part 101 confirms the presence or absence of the recording material on the paper feeding tray 8 by the sensor S1, permits paper feeding operation driven by the paper feeding roller 81 when the presence of the recording material is confirmed, prohibits print operation of the printer 100 when the absence of the recording material is confirmed, and indicates a warning of the absence of the recording material on the host device 200.

When the recording material presence or absence sensor S1 detects the presence of the recording material, when the paper feeding roller 81 is driven, the recording material P on the paper feeding tray 8 is fed inside the printer 100 in the center paper feeding reference and print operation with respect to the recording material is carried out as in the above-mention.

Further, the before-mentioned top sensor S2 and the paper discharge sensor S3 are disposed at a position nearer the recording material center paper feeding reference line so as to detect the recording material with any paper width of many sizes, being set on the paper feeding tray 8 and fed in the center reference.

However, in the case of feeding the recording material from the cassette paper feeding part 7, the large size recording material and the small size recording material are almost certainly fed and transported in the center reference. However, in the case of feeding paper from the paper feeding tray 8, there is a possible situation in which the small size recording material is not often correctly set on the paper feeding tray 8. By this, there is a possibility that the small size recording material is fed and transported to inside the printer like one side paper feeding reference conveyance in lateral deviation from the center line O of the paper feeding reference.

That is, regarding the setting of the recording material P to the paper feeding tray 8, as described above, while the space between the regulation plates 82 is spread, the recording material P is placed on the paper feeding tray 8 therebetween; then, the regulation plates 82 are narrowed in accordance with a width of the recording material P. By this operation, the left and the right sides of the recording material P are regulated between inner sides of the left and the right regulation plates 82 to set so that the paper width center substantially conforms to the center line O of the paper feeding reference. However, in the setting of the small size recording material, for example, in a state that a side of the recording material is put into contact with one of the inner side of the left and the right regulation plates 82 which are spread large as shown in FIG. 17 to FIG. 20, there is a possible case in which the left and the right regulation plates 82 are not narrowed in accordance with the paper width of the recording material P. In this case, the small size recording material is offset to the left side or the right side on the paper feeding tray 8 as in the case of the paper feeding tray of the one side paper feeding reference conveyance.

Figure 17:
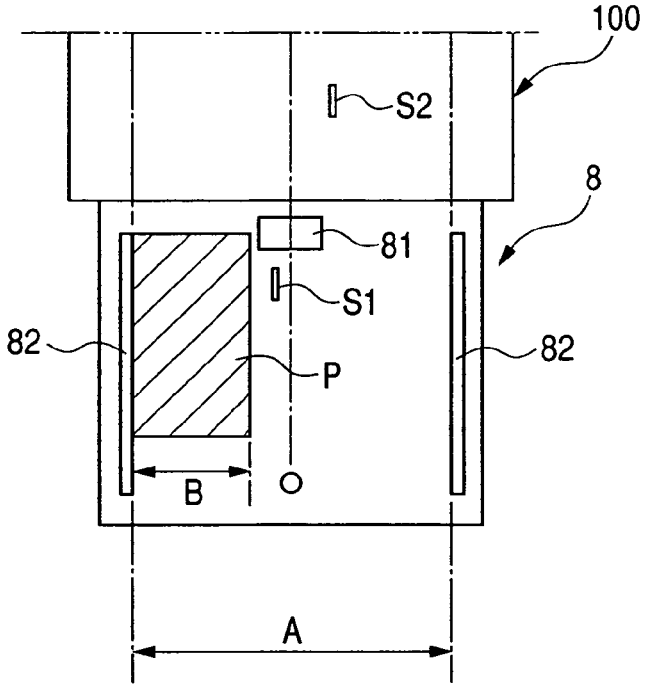
FIG. 17 is a plan view of a state in which the small size recording material is not correctly set to the paper feeding tray (a first state).
Figure 18:
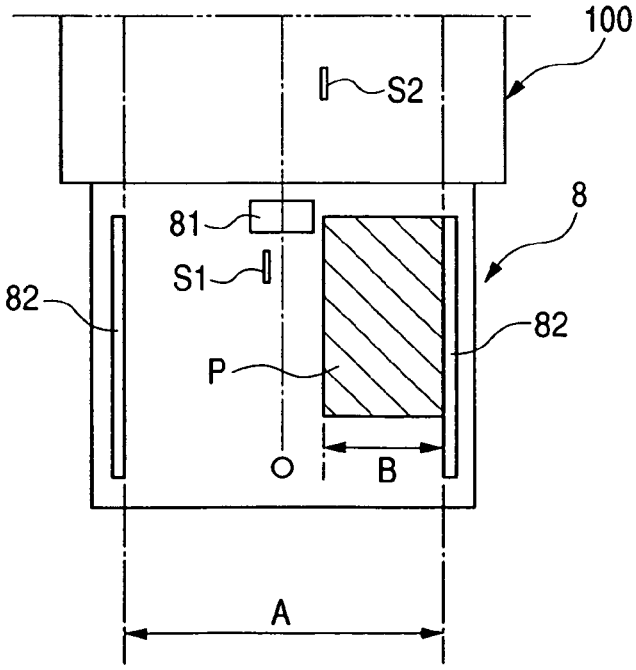
FIG. 18 is a plan view of a state in which the small size recording material is not correctly set to the paper feeding tray (a second state).

In an offset state of the small size recording material, when the recording material P in the offset state as shown in FIG. 17 and FIG. 18 does not cover over the position of the recording material presence or absence sensor S1 on the paper feeding tray 8 due to a relatively small paper width of the recording material P, the printer control part 101 prohibits print operation of the printer 100 and makes the host device 200 indicate a warning of the absence of the recording material because the sensor S1 detects the absence of the recording material even paper feeding from the paper feeding tray 8 is selected. Operators notice a setting error of the recording material by watching the state of the paper feeding tray 8 according to the warning indication.

However, when the recording material P covers over the position of the recording material presence or absence sensor S1 as shown in FIG. 19 and FIG. 20 in the offset state of the recording material because the paper width is relatively large even in the small size recording material, the sensor S1 detects the presence of the recording material. Therefore, since the sensor S1 detects the presence of the recording material, the printer control part 101 permits paper feeding operation driven by the paper feeding roller 81 and executes print operation of the printer 100.

In this case, the one side end portion temperature detection part TH2 or the other side end portion temperature detection part TH3 arranged on the side in which the recording material is offset, is covered within the paper feeding area. Therefore, a temperature rise at the fixing roller non-paper feeding part cannot be detected by the end portion temperature detection part. However, the temperature rise at the fixing roller non-paper feeding part can be accurately detected by the other end portion temperature detection part. The printer control part 101 performs device control based on temperature detection information of the fixing roller non-paper feeding part, input from the other end portion temperature detection part. That is, the printer control part 101 performs controls such as controlling supply power to the halogen heater 11*c* which is a fixing roller heat source or changing a conveyance time interval of the recording material so that the temperature at the portion corresponding to the non-paper feeding area width C of the fixing roller 11*a* becomes not more than a predetermined allowable temperature. This enables to prevent from thermal loss or the like of the apparatus. In this regard, the printed out material seemed like an image with lateral deviation or a defective image is a misprint.

Further, the printer control part 101 determines that an arrangement of the recording material on the paper feeding tray 8 which is the paper feeding part is not proper (recording material setting defect) when, of the detection temperatures of the one side end portion temperature detection part TH2 and the other side end portion temperature detection part TH3, one side detection temperature is higher than the other side detection temperature and the other side detection temperature is substantially the same as a detection temperature of the central portion temperature detection part TH1. Then, the printer control part 101 prohibits print operation of the printer 100 and makes the host device 200 indicate a warning of the recording material setting defect. This enables to notify users of a proper recording material set capable of providing maximum performance without giving damage on the apparatus.

In the case of the recording material setting defect of FIG. 19 and FIG. 20, formation of toner image with respect to the photosensitive drum 1 is performed in response to the center reference conveyance of the recording material, whereas, an actual recording material fed and transported to inside the printer is in a state of the left or the right deviation from the center line O of the paper feeding reference, and therefore, a misprint, which is an image with lateral deviation or a defective image formed on the recording material, is output. Misprint to be continuously output can be prevented by prohibiting print operation as described above.

Embodiment 4

Figure 21:
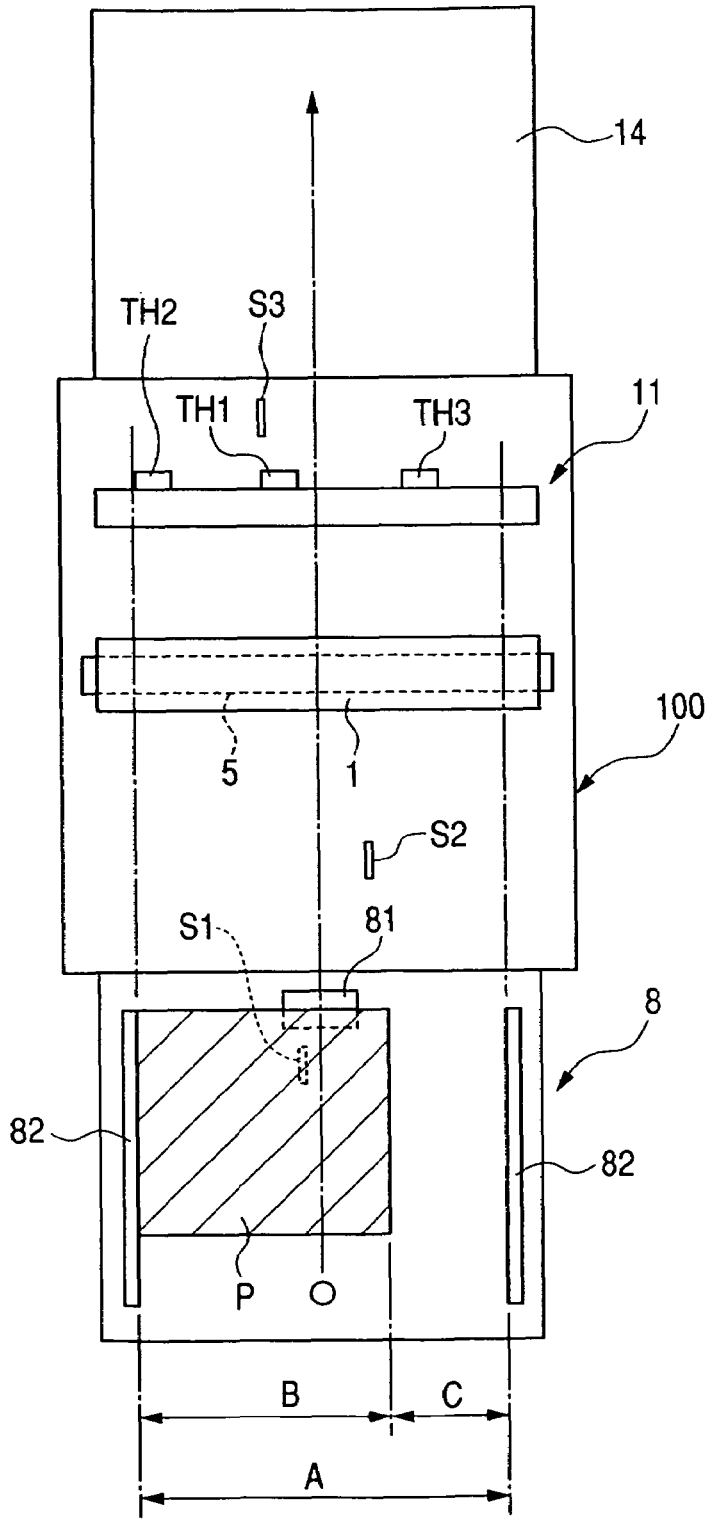
FIG. 21 is a schematic development plan view of a recording material conveyance path from a paper feeding tray to a paper discharge tray of an example of an image forming apparatus according to Embodiment 4.

FIG. 21 is an explanatory view of Embodiment 4. FIG. 21 is a schematic development plan view of the recording material conveyance path from the paper feeding tray 8 of the printer 100 to the paper discharge tray 14, as in FIG. 14 of the printer of Embodiment 3. Members and portions that are also used in the printer of Embodiment 3 are given by the same the reference numerals/characters and their description will not be repeated.

In this embodiment, the one side end portion temperature detection part TH2 and the other side end portion temperature detection part TH3 are disposed at an asymmetric position with respect to the position of center line O of the paper feeding reference O. The printer control part 101 serving as control means is featured to control the apparatus based on the output of the end portion temperature detection part whose temperature, detected by the one side end portion temperature detection part TH2 and the other side end portion temperature detection part TH3, is the highest.

The one side end portion temperature detection part TH2 and the other side end portion temperature detection part TH3 are disposed at an asymmetric position with respect to the position of the center line O of the paper feeding reference, whereby it is possible to accurately detect a peak temperature in the longitudinal direction of the fixing roller even when various widths of the recording paper sheets are fed and it is possible to control so that paper feeding with the maximum printing speed in respective kinds of paper sheets is performed.

Further, in this embodiment, as in the case of FIG. 19 and FIG. 20, the one side end portion temperature detection part TH2 or the other side end portion temperature detection part TH3 arranged on the side in which the recording material is offset, is covered within the paper feeding area. Therefore, a temperature rise at the fixing roller non-paper feeding part cannot be detected by the end portion temperature detection part. However, the temperature rise at the fixing roller non-paper feeding part can be accurately detected by the other end portion temperature detection part. The printer control part 101 performs device control based on temperature detection information of the fixing roller non-paper feeding part, input from the other end portion temperature detection part. That is, the device control is performed based on the output of the end portion temperature detection part whose temperature, detected by the one side end portion temperature detection part TH2 and the other side end portion temperature detection part TH3, is the highest. More specifically, the printer control part 101 controls supply power to the halogen heater 11*c* which is a fixing roller heat source or changing a conveyance time interval of the recording material so that the temperature at the portion corresponding to the non-paper feeding area width C of the fixing roller 11*a* becomes not more than a predetermined allowable temperature. This enables to prevent from thermal loss or the like of the apparatus. In this regard, the printed out material seemed like an image with lateral deviation or a defective image is a misprint.

Further, the printer control part 101 determines that an arrangement of the recording material on the paper feeding tray 8*a* which is the paper feeding part is not proper when, of the detection temperatures of the one side end portion temperature detection part TH2 and the other side end portion temperature detection part TH3, one side detection temperature is higher than a predetermined temperature and the other side detection temperature is substantially the same as a detection temperature of the central portion temperature detection part TH1. Then, the printer control part 101 prohibits print operation of the printer 100 and makes the host device 200 indicate a warning of the recording material setting defect.

Here, in the above-mentioned Embodiment 1 or Embodiment 2, the apparatus may be configured by a plurality of one side end portion temperature detection part TH2 and a plurality of other side end portion temperature detection part TH3.

In the above-mentioned Embodiments 1 to 4, the heating device used for the fixing device is not limited to the heating device of the heat roller system of the embodiments, but a heating device of a film heating system using a ceramic heater as disclosed in, for example, Japanese patent Application Laid-open No. 4-44075, a heating device of an electromagnetic induction heating system, and the like may be optionally used.

Further, the image forming system of an unfixed image with respect to the recording material is not limited to the electrophotographic system of the transfer type, but an electrophotographic system of a direct type, an electrostatic recording system of a transfer type or a direct type, a magnetic recording system, and the like may be optionally used.

This application claims priorities from Japanese Patent Application Nos. 2004-262923 filed on Sep. 9, 2004, and 2004-323639 filed on Nov. 8, 2004, which are hereby incorporated by reference herein.

What is claimed is:

1. An image forming apparatus having a heat member for heating a recording material which bears an unfixed image thereon, configured so that a longitudinal center of the heat member corresponds to a conveyance center of the recording material, said image forming apparatus comprising:

a central portion temperature detection part disposed adjacent to the conveyance center, for controlling a temperature of the heat member to be a desired temperature;

an end portion temperature detection part for detecting an end portion temperature of the heat member; and a width detection part for detecting a lateral width of the recording material, wherein said width detection part is disposed at a side opposite to a side at which said end portion temperature detection part is disposed with respect to the conveyance center position of the recording material, and wherein a plurality of the width detection parts are disposed within an area from the conveyance center position to an end portion of the recording material, and at least one of the plurality of the width detection parts is disposed at a symmetric position with respect to the end portion temperature detection part and the conveyance center position.

2. An image forming apparatus according to claim 1, further comprising a control part for determining whether or not the recording material is correctly set based on an output of the width detection part and an output of the end portion temperature detection part.

3. An image forming apparatus according to claim 1, further comprising a control part for controlling supply power for heating the heat member or a conveyance interval of the recording material or stopping image forming operation, based on an output of the width detection part and an output of the end portion temperature detection part.

* * * * *

UNITED STATES PATENT AND TRADEMARK OFFICE

CERTIFICATE OF CORRECTION

PATENT NO. : 7,397,488 B2
APPLICATION NO. : 11/211445
DATED : July 8, 2008
INVENTOR(S) : Ito et al.

It is certified that error appears in the above-identified patent and that said Letters Patent is hereby corrected as shown below:

COLUMN 1:
Line 16, “plurality” should read --plurality of--.
Line 55, “miss handling” should read --mishandling--.
Line 59, “a a center” should read --a center--.

COLUMN 3:
Line 13, “an one side” should read --one side--.
Line 16, “an another” should read --another--.
Line 51, “miss handling” should read --mishandling--.

COLUMN 6:
Line 67, “denotes of” should read --denotes--.

COLUMN 7:
Line 33, “thermister” should read --thermistor--.
Line 41, “even a” should read --even when a--.
Line 54, “a area” should read --an area--.

COLUMN 10:
Line 16, “doe not” should read --does not--.

COLUMN 11:
Line 6, “changing” should read --changes--.
Line 13, “seemed” should read --seems--.
Line 39, “the same the” should read --the same--.
Line 55, “cover” should read --covers--.

COLUMN 12:
Line 28, “a A4-size” should read --A4 size--.
Lines 32 and 34, “detection S4” should read --detection part S4--.

COLUMN 13:
Line 43, “thermister,” should read --thermistor,--.
Line 53, “area even” should read --area, even--.

COLUMN 16:
Line 9, “material even” should read --material, even--.
Line 44, “seemed” should read --seems--.
Line 59, “material set” should read --material setting--.
Line 42, “from thermal” should read --thermal--.

UNITED STATES PATENT AND TRADEMARK OFFICE

CERTIFICATE OF CORRECTION

PATENT NO. : 7,397,488 B2
APPLICATION NO. : 11/211445
DATED : July 8, 2008
INVENTOR(S) : Ito et al.

It is certified that error appears in the above-identified patent and that said Letters Patent is hereby corrected as shown below:

COLUMN 17:
Line 13, “same the” should read --same--.
Line 53, “changing” should read --changes--.
Line 58, “from thermal” should read --thermal--.

COLUMN 18:
Line 16, “patent” should read --Patent--.

Signed and Sealed this

Twenty-seventh Day of January, 2009

JOHN DOLL
*Acting Director of the United States Patent and Trademark Office*